US007204570B2

(12) United States Patent
Benitsch et al.

(10) Patent No.: US 7,204,570 B2
(45) Date of Patent: Apr. 17, 2007

(54) REFRIGERATOR FOR BOTTLES

(75) Inventors: Roland Benitsch, Nattheim (DE); Rainer Brachert, Gundelfingen (DE); Hans Haas, Heidenheim (DE); Christian Mayershofer, Grundremmingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/801,965

(22) Filed: Mar. 15, 2004

(65) Prior Publication Data

US 2004/0174108 A1 Sep. 9, 2004

Related U.S. Application Data

(63) Continuation of application No. PCT/EP02/10211, filed on Sep. 11, 2002.

(30) Foreign Application Priority Data

Sep. 13, 2001 (DE) ..... 101 45 143

(51) Int. Cl.
*A47B 96/02* (2006.01)

(52) U.S. Cl. ..... 312/408; 62/382; 211/153

(58) Field of Classification Search ..... 312/401, 312/402, 405.1, 408, 410, 116, 228.1, 126, 312/128; 62/382, 440; 211/74, 153
See application file for complete search history.

(56) References Cited

U.S. PATENT DOCUMENTS

| | | | | | |
|---|---|---|---|---|---|
| 410,911 | A | * | 9/1889 | Mertz | 62/266 |
| 1,204,347 | A | * | 11/1916 | Canio | 312/290 |
| 1,707,484 | A | * | 4/1929 | Keener | 62/382 |
| 1,767,976 | A | * | 6/1930 | Graves | 62/379 |
| 1,987,797 | A | * | 1/1935 | Rorrer et al. | 312/128 |
| 2,294,749 | A | * | 9/1942 | Harbison | 312/408 |
| 2,428,718 | A | * | 10/1947 | Nauert | 211/153 |
| 2,634,867 | A | * | 4/1953 | Shields | 211/153 |
| 3,570,682 | A | * | 3/1971 | Elliott | 211/126.15 |
| 4,101,233 | A | | 7/1978 | McConnell | 211/187 X |
| 4,138,175 | A | * | 2/1979 | Tattershall | 312/408 |
| 4,341,314 | A | * | 7/1982 | Feuerstein | 211/184 |
| 5,167,903 | A | * | 12/1992 | Anderson | 266/49 |
| 5,279,431 | A | * | 1/1994 | Highsmith et al. | 211/189 |
| 5,322,173 | A | | 6/1994 | Kay | 211/153 |
| 5,330,261 | A | * | 7/1994 | Bennett | 312/321.5 |
| 5,688,034 | A | * | 11/1997 | Kojima | 312/408 |
| 5,779,068 | A | * | 7/1998 | Whiten et al. | 211/117 |

FOREIGN PATENT DOCUMENTS

| | | | |
|---|---|---|---|
| DE | 3247604 | * | 7/1984 |
| DE | 44 35 812 C1 | | 2/1996 |
| JP | 11351737 A | | 12/1999 |

* cited by examiner

*Primary Examiner*—James O. Hansen
(74) *Attorney, Agent, or Firm*—Russell W. Warnock; Craig J. Loest

(57) ABSTRACT

A refrigerator includes a housing having a cooled interior space. At least one drawer is disposed in the interior space for storing bottles in an inclined or horizontal position. The drawer has a frame with two opposite sides. The drawer also has a plurality of rods to be releasably mounted parallel to and spaced apart from one another between the two opposite sides of the frame at selectable distances from one another.

3 Claims, 3 Drawing Sheets

REFRIGERATOR FOR BOTTLES

CROSS-REFERENCE TO RELATED APPLICATION

This application is a continuation, under 35 U.S.C. § 120, of copending International Application No. PCT/EP02/10211, filed Sep. 11, 2002, which designated the United States; this application also claims the priority, under 35 U.S.C. § 119, of German Patent Application 101 45 143.1, filed Sep. 13, 2001; the prior applications are herewith incorporated by reference in their entirety.

BACKGROUND OF THE INVENTION

Field of the Invention

The present invention relates to a refrigerator for storing bottles, in particular wine bottles, in a reclining or horizontal position. The refrigerator has a cooled interior space with at least one drawer for receiving the bottles.

In a known refrigerator of that type, the drawers are constructed as single-part sheet-metal troughs with holes which are punched into the floor of the trough and are provided in order to receive and hold the bottom of a bottle. The distance between the holes firstly has to be as small as possible in order to be able to store the greatest possible number of bottles in a limited interior volume of the refrigerator, and secondly should not be smaller than the maximum diameter of the bottles, since otherwise not every hole can receive a bottle.

Wine bottles of different sizes and shapes are used. If such different types of bottles are to be stored in a refrigerator, then an optimum utilization of space cannot be obtained with a uniform type of trough. Although it would be conceivable to equip the refrigerator with a plurality of drawers in which the distances between the holes of the troughs differ in each case, the production of those troughs would require differently adapted punching tools in each case and is therefore very expensive.

SUMMARY OF THE INVENTION

It is accordingly an object of the invention to provide a refrigerator for storing bottles in a reclining or horizontal position, which overcomes the hereinafore-mentioned disadvantages of the heretofore-known devices of this general type and in which drawers of the refrigerator can be adapted in a simple and inexpensive manner to different bottle diameters.

With the foregoing and other objects in view there is provided, in accordance with the invention, a refrigerator, comprising a housing having a cooled interior space. At least one drawer is disposed in the interior space for storing bottles in a reclining or horizontal position. The drawer has a frame with two opposite sides. The drawer also has a plurality of rods to be releasably mounted parallel to and spaced apart from one another between the two opposite sides of the frame at selectable distances from one another.

Due to the mounting of the rods at a suitable distance, it is possible for a drawer of this type to be adapted in a simple manner to the storage of bottles of different diameter without a multiplicity of different parts being required for this purpose. The rods may be installed permanently by the refrigerator manufacturer. However, it is also conceivable to provide a releasable installation of the rods making it possible for a user to adapt the position of the rods retrospectively and repeatedly to his or her current needs.

In addition, a multipart construction of this type has the advantage of permitting different materials to be used for the various parts of the drawer, which gives rise to diverse, novel and esthetic design possibilities.

In accordance with another feature of the invention, the rods are preferably rounded upwards in cross section, so that, irrespective of the particular diameter of the bottles, the possibility of the bottles resting on a sharp edge is avoided. In particular, the cross section of the rods may be in the shape of a segment of a circle, for example semicylindrical or completely cylindrical.

The larger the diameter of the rounding, the larger the variation or spread of the diameters of bottles which can be stored on the drawer at a given distance between the rods. The smaller the diameter, the greater the proportion of openings situated between the rods over the entire surface of the drawer. That is desirable in turn in order to promote vertical air flows within the refrigerator and therefore an efficient temperature equalization, which makes it possible to cool newly inserted bottles in a rapid and controlled manner. A diameter of the rounding of approximately 20 mm constitutes a sensible compromise between these two requirements.

Other features which are considered as characteristic for the invention are set forth in the appended claims.

Although the invention is illustrated and described herein as embodied in a refrigerator for bottles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
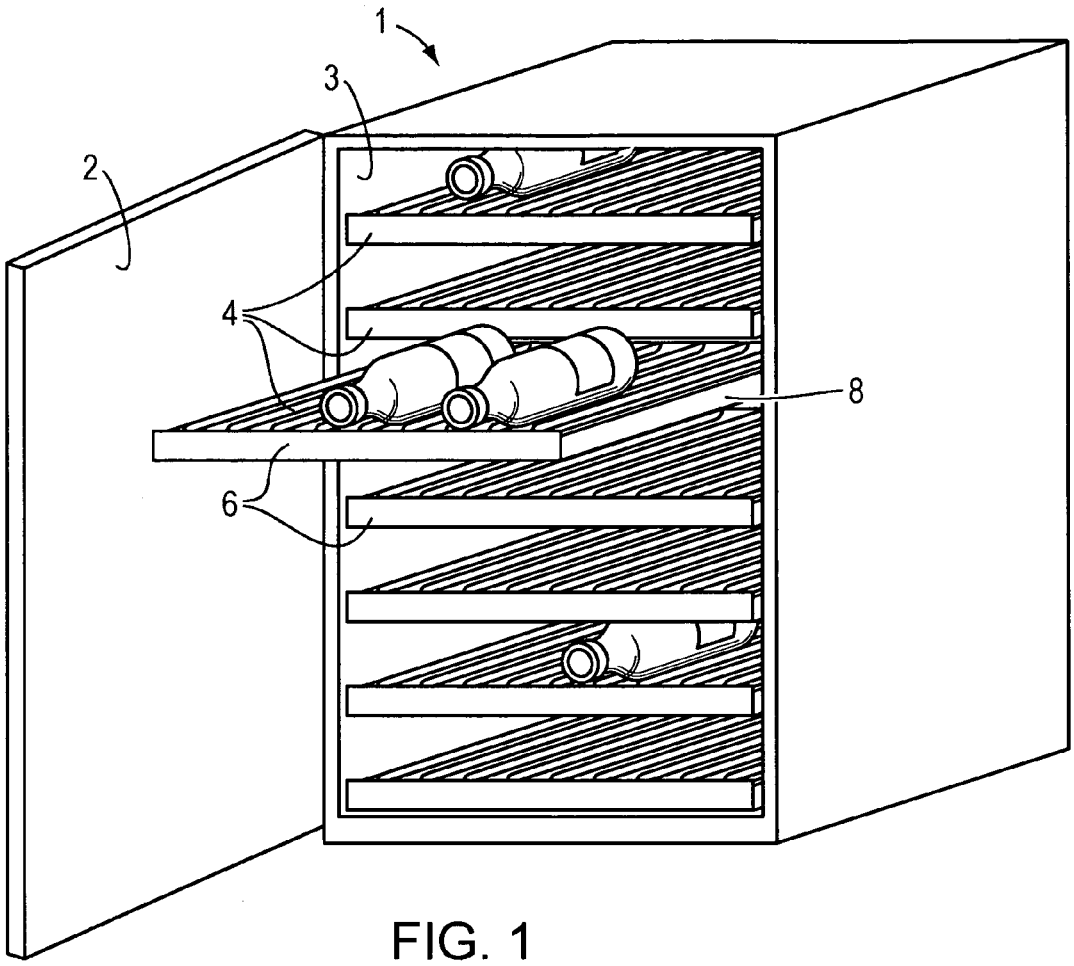
FIG. 1 is a diagrammatic, perspective view of a refrigerator according to the invention, shown with the door open.

Referring now to the figures of the drawings in detail and first, particularly, to FIG. 1 thereof, there is seen a diagrammatic, perspective view of a novel refrigerator 1 for bottles, which is illustrated with a door 2 being open. A plurality of drawers 4 is fitted in an interior space 3 of a housing of the refrigerator in such a manner that each can be pulled out through the use of a telescopic rail mechanism. Since the telescopic rail mechanism is known per se, it is only briefly described in more detail below.

Figure 2:
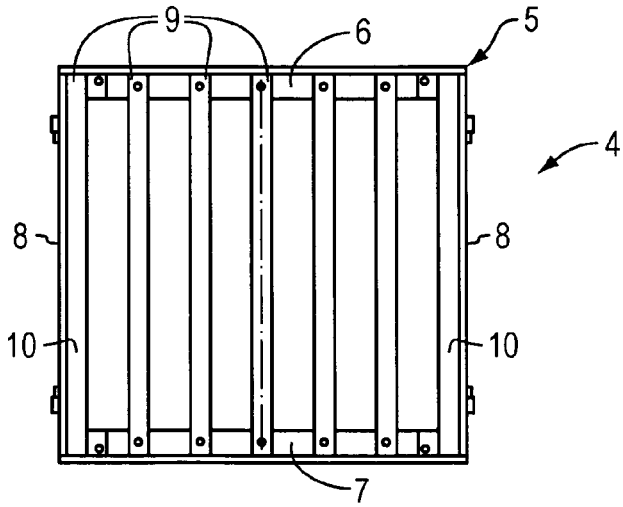
FIG. 2 is a plan view of a drawer of the refrigerator of FIG. 1.

The drawers 4, one of which is shown in a plan view in FIG. 2, each include a rigid, rectangular frame 5, which is composed of a front profile or side element 6 that faces the door 2 in a fitted state, a rear profile or side element 7 and two lateral rails 8 interconnecting the profiles 6, 7. The rails 8 at the same time are part of the telescopic rail mechanism.

A plurality of rods 9, 10 having a circular cross section is mounted parallel and spaced apart from one another between the two profiles 6, 7 and parallel to the rails 8. In this case, the two outer rods 10 overlap upper sides of the rails 8, with the result that the latter are scarcely visible to a user.

The frame 5 is therefore composed of a plurality of different parts 6 to 10 which can be manufactured from different materials for expediency as well as esthetic considerations. The lateral rails 8 can thus be formed in a conventional manner from sheet steel while aluminum, if appropriate with a colored anodization, can be used for the profiles 6, 7 and, for example, wood, in particular beechwood, can be used for the rods 9, 10.

Figure 3:
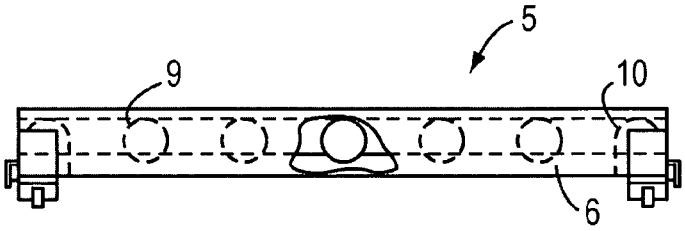
FIG. 3 is a partially-sectional, front-elevational view of the drawer.

FIG. 3 shows a front view of the frame 5, in which the cross sections of the rods 9, 10, which are concealed by the front profile 6 and are not visible per se, are illustrated in phantom. The rods 9, 10 have a rounded cross section at least in their upper region. In the case of the exemplary embodiment shown herein, the rods 9 are cylindrical while the cross section of the outer rods 10, which can be seen more clearly in the enlarged illustration of the fragmentary view of FIG. 4, is composed of a substantially semicylindrical and a rectangular section.

Figure 4:
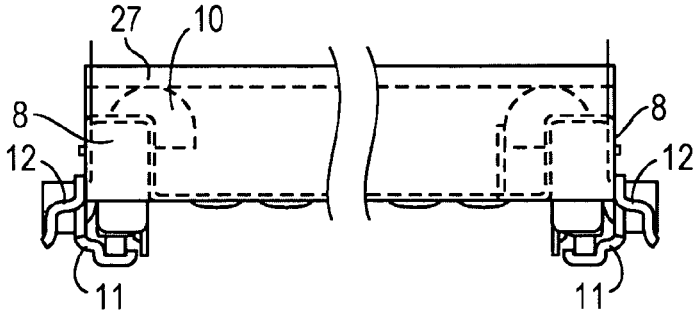
FIG. 4 is an enlarged, fragmentary view of a portion of FIG. 3.

FIG. 4 also shows positionally fixed rails 11 which are provided for installation on the walls of the interior space 3 with the aid of hooks 12 formed integrally on them. The fixed rails 11, together with the rails 8 of the frame 5, form the telescopic rail mechanism.

Figure 6:
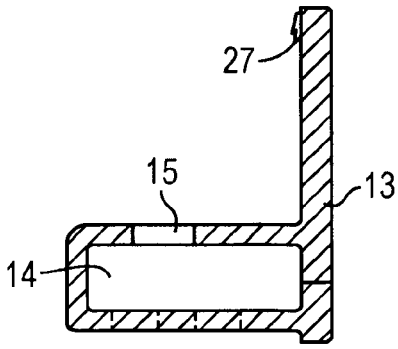
FIG. 6 is a sectional view of the profile of FIG. 5.
Figure 5:
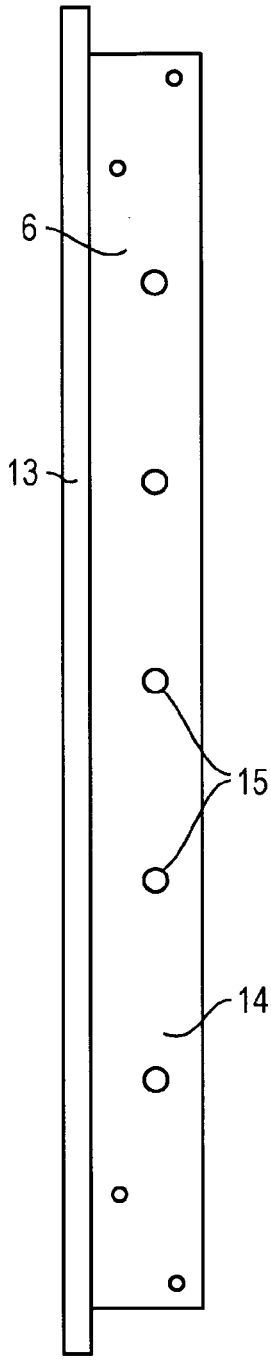
FIG. 5 is a plan view of a front profile of a frame of the drawer of FIG. 3.

FIG. 5 shows a plan view of the front profile 6 of the frame 5. A cross section through the profile 6 is shown in FIG. 6. The profile 6 is a single or one-piece part composed of a front panel 13 and a hollow profile section 14 of substantially rectangular cross section, in which holes 15 are formed at regular intervals. The front panel 13 has a latching projection 27 which is disposed on its rear side and extends along from its upper edge. The length of the rods 9, 10 is dimensioned exactly in such a way that they engage, in the fitted position, directly under the latching projection 27, as can be seen for the rods 10 in FIG. 4, and are held in situ by the latching projection. The front panel 13 protrudes laterally over the ends of the hollow profile section, so that it also conceals the ends of the rails 8.

Figure 7:
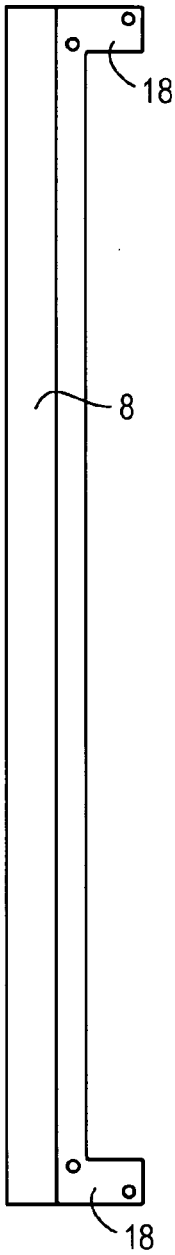
FIG. 7 is a plan view of a lateral rail of the frame of FIG. 2.
Figure 8:
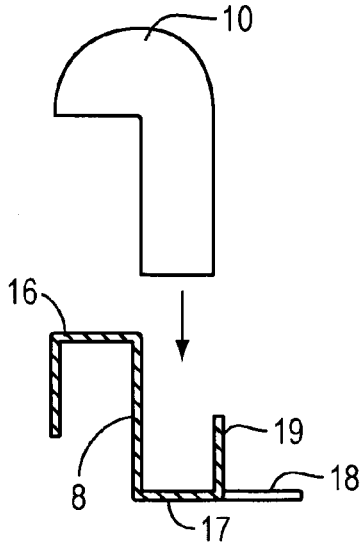
FIG. 8 is a sectional view of the rail of FIG. 7.

One of these rails 8 is shown in a plan view in FIG. 7, and FIG. 8 shows a cross section of the rail 8 and of the outer rod 10 which is provided for installation on this rail 8. The rail 8 is constructed from a section 16, which has the cross section of a downwardly open U, with one limb of the U being extended by a horizontal section 17. This section 17 is divided by two cuts in the longitudinal direction of the rail into three parts 18, 19. Two of these parts in each case are horizontally orientated tabs 18 for connecting the rail 8 to the front or rear profile 6, 7. The cross section of the rear profile 7 is identical to the cross section of the front profile 6 that is shown in FIG. 6. The tabs 18 are provided in each case in order to be placed against the lower side of the hollow profile section 14 of the front or rear profile 6 or 7 and to be fastened thereto with the aid of blind rivets. A central part 19, which takes up the major part of the length of the rail 8, is angled upward in order to form an upwardly open groove, in which the rod 10 can be inserted and held by clamping.

Figure 9:
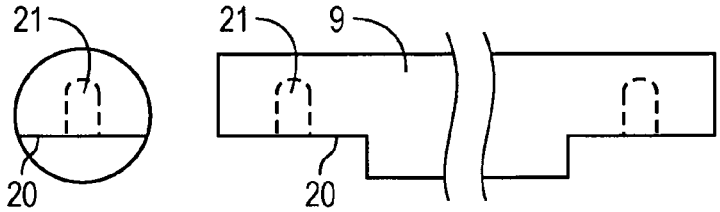
FIG. 9 includes a front-elevational and a side-elevational view of a rod of the drawer.
Figure 10:
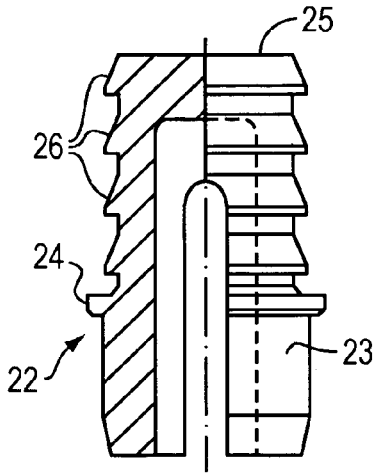
FIG. 10 is a partially-sectional, elevational view of a fastening pin for fastening the rod of FIG. 9 to the profile of FIG. 5.

FIG. 9 shows one of the rods 9 in each of a front view and a side view. A respective flattened section 20 which is formed at the ends of the substantially cylindrical rod 9 permits the rod 9 to be placed onto the hollow profile section 14 of the front and rear profile 6, 7. A blind drilled hole 21, which is illustrated in phantom in each case in FIG. 9, emerges from the flattened section 20. Like the holes 15 of the hollow profile section 14, this blind drilled hole 21 serves to receive a fastening pin 22, which is shown in a partial section in FIG. 10.

The fastening pin 22 has a downwardly tapered and slit, lower section 23 which can be introduced into a hole 15 in the profile 6 until a rim 24, which forms the end of the lower section 23, comes to lie on the hollow profile section 14. An upper section 25 of the fastening pin bears a plurality of peripheral projections 26 which are deformed when the upper section 25 is introduced into a blind drilled hole 21 and which oppose pulling the fastening pin out of the blind drilled hole. This forms a plug-in connection between the rods 9 and the front and rear profiles or side elements 6, 7.

In the exemplary embodiment shown in the figures, the number of holes 15 in the profile 6, 7 corresponds to the number of rods 9 fitted to the drawer. In this configuration, a user does not have the possibility of adapting the distance between the rods to the diameter of the bottles to be stored on the drawer, except by removing individual rods 9 and not replacing them. However, the drawer manufacturer can easily adapt the distance between the rods to any desired bottle format by appropriate positioning of the holes 15.

Of course, a larger number of holes 15 than the number of fitted rods 9 may also be provided so that the distance between the rods is selectable. In particular, it is conceivable to provide a plurality of series of equidistant holes in each case in the profiles 6, 7, with the number of holes in the series and therefore their distance from one another differing from one series to another. In this case, one hole may also belong to a plurality of series, in particular if the numbers of holes in the series, which are increased in each case by one, are not relatively prime numbers.

Of course, instead of the holes, fastening devices may also be provided for the rods. It is possible for the fastening devices to be displaced arbitrarily along the profiles by a user. This permits a very flexible adaptation of the distance between the rods to extremely different bottle formats but can give rise to the problem that the parallelism among the rods cannot be ensured as simply as in the case of the holes 15 being pre-manufactured by the manufacturer. The parallelism of the rods should be satisfied at least in a precise enough manner to ensure that if a drawer is shaken, for example as it is being pulled out, the bottles do not begin to migrate in the direction of an increasing distance between the rods.

We claim:

1. A refrigerator, comprising:

a housing having a cooled interior space;

at least one drawer disposed in said interior space for storing bottles;

said at least one drawer having a frame with two opposite sides;

said at least one drawer having a plurality of rods releasably mounted parallel to and spaced apart from one another between said two opposite sides of said frame at selectable distances from one another;

wherein said frame has opposite side elements, and said rods are mounted to said opposite side elements by a plug-in connection;

wherein at least one of said side elements has a projection facing an opposite one of said side elements, for latching one end of each of said rods.

2. A refrigerator, comprising:

a housing having a cooled interior space;

at least one drawer disposed in said interior space for storing bottles;

said at least one drawer having a frame with two opposite sides, said frame including opposite side elements; and said at least one drawer having a plurality of rods to be releasably mounted parallel to and spaced apart from one another between said two opposite sides of said frame at selectable distances from one another, said rods mounted to said opposite side elements by a plug-in connection, said plug-in connection includes a pin formed of a flexible material and having one end engaging in a drilled hole in one of said side elements and another end engaging in a blind drilled hole in one of said rods.

3. The refrigerator according to claim 2, wherein said pin is oriented vertically.

* * * * *